US009773597B2

(12) United States Patent
Ikeda et al.

(10) Patent No.: US 9,773,597 B2
(45) Date of Patent: Sep. 26, 2017

(54) COMPOSITE SOFT MAGNETIC MATERIAL HAVING LOW MAGNETIC STRAIN AND HIGH MAGNETIC FLUX DENSITY, METHOD FOR PRODUCING SAME, AND ELECTROMAGNETIC CIRCUIT COMPONENT

(75) Inventors: Hiroaki Ikeda, Kitamoto (JP); Hiroshi Tanaka, Naka (JP); Kazunori Igarashi, Kitamoto (JP)

(73) Assignees: MITSUBISHI MATERIALS CORPORATION, Tokyo (JP); DIAMET CORPORATION, Niigata-Shi (JP)

( * ) Notice: Subject to any disclaimer, the term of this patent is extended or adjusted under 35 U.S.C. 154(b) by 899 days.

(21) Appl. No.: 13/979,988

(22) PCT Filed: Feb. 22, 2012

(86) PCT No.: PCT/JP2012/054245

§ 371 (c)(1),
(2), (4) Date: Jul. 16, 2013

(87) PCT Pub. No.: WO2012/115137

PCT Pub. Date: Aug. 30, 2012

(65) Prior Publication Data

US 2013/0298730 A1 Nov. 14, 2013

(30) Foreign Application Priority Data

Feb. 22, 2011 (JP) ..... 2011-035752
Feb. 21, 2012 (JP) ..... 2012-035434

(51) Int. Cl.
*H01F 1/24* (2006.01)
*H01F 41/02* (2006.01)
(Continued)

(52) U.S. Cl.
CPC ..... *H01F 1/24* (2013.01); *B22F 1/02* (2013.01); *B22F 1/025* (2013.01); *B22F 3/16* (2013.01);
(Continued)

(58) Field of Classification Search
None
See application file for complete search history.

(56) References Cited

U.S. PATENT DOCUMENTS

2003/0024607 A1* 2/2003 Takemoto ..... H01F 1/14791 148/309
2009/0242825 A1* 10/2009 Ohwaki ..... B22F 1/02 252/62.54
2010/0212455 A1* 8/2010 Ohwaki ..... B22F 1/02 75/246

FOREIGN PATENT DOCUMENTS

CN 101755313 A 6/2010
JP 08-134605 A 5/1996
(Continued)

OTHER PUBLICATIONS

Machine translation of JP2005-303006A, Oct. 2005.*
(Continued)

*Primary Examiner* — Xiaowei Su
(74) *Attorney, Agent, or Firm* — Leason Ellis LLP

(57) ABSTRACT

A composite soft magnetic material having low magnetostriction and high magnetic flux density contains: pure iron-based composite soft magnetic powder particles that are subjected to an insulating treatment by a Mg-containing insulating film or a phosphate film; and Fe—Si alloy powder particles including 11%-16% by mass of Si. A ratio of an amount of the Fe—Si alloy powder particles to a total amount is in a range of 10%-60% by mass. A method for producing the composite soft magnetic material comprises the steps of: mixing a pure iron-based composite soft
(Continued)

magnetic powder, and the Fe—Si alloy powder in such a manner that a ratio of the Fe—Si alloy powder to a total amount is in a range of 10%-60%; subjecting a resultant mixture to compression molding; and subjecting a resultant molded body to a baking treatment in a non-oxidizing atmosphere.

15 Claims, 5 Drawing Sheets

(51) Int. Cl.

| | |
|---|---|
| ***B22F 1/02*** | (2006.01) |
| ***B22F 3/16*** | (2006.01) |
| ***C22C 33/02*** | (2006.01) |
| ***C22C 38/02*** | (2006.01) |
| *H01F 3/08* | (2006.01) |
| *H01F 27/255* | (2006.01) |
| *H01F 1/26* | (2006.01) |
| *H01F 1/33* | (2006.01) |

(52) U.S. Cl.
CPC ..... *C22C 33/0214* (2013.01); *C22C 38/02* (2013.01); *H01F 41/0246* (2013.01); *H01F 1/26* (2013.01); *H01F 1/33* (2013.01); *H01F 3/08* (2013.01); *H01F 27/255* (2013.01)

(56) References Cited

FOREIGN PATENT DOCUMENTS

| | | | | | |
|---|---|---|---|---|---|
| JP | EP 1052043 | A2 | * | 11/2000 | ..... B22F 3/18 |
| JP | 2000-345211 | A | | 12/2000 | |
| JP | 2005303006 | A | * | 10/2005 | |
| JP | 2006-135164 | A | | 5/2006 | |
| JP | 2006-332328 | A | | 12/2006 | |
| JP | 2008-192897 | A | | 8/2008 | |
| JP | 2009-032880 | A | | 2/2009 | |
| JP | 2010-126786 | A | | 6/2010 | |
| JP | 2010-153638 | A | | 7/2010 | |
| JP | WO 2010073590 | A1 | * | 7/2010 | ..... B22F 1/0003 |
| WO | WO-2009/060895 | A1 | | 5/2009 | |

OTHER PUBLICATIONS

Machine translation of WO2010073590A1, Jul. 2010.*
Office Action mailed Apr. 28, 2015 for the corresponding Chinese Application No. 201280005107.4.
International Search Report mailed May 22, 2012 for the corresponding PCT Application No. PCT/JP2012/054245.

* cited by examiner

COMPOSITE SOFT MAGNETIC MATERIAL HAVING LOW MAGNETIC STRAIN AND HIGH MAGNETIC FLUX DENSITY, METHOD FOR PRODUCING SAME, AND ELECTROMAGNETIC CIRCUIT COMPONENT

CROSS-REFERENCE TO RELATED PATENT APPLICATIONS

This application is a U.S. National Phase application under 35 U.S.C. §371 of International Patent Application No. PCT/JP2012/054245, filed Feb. 22, 2012, and claims the benefit of Japanese Patent Applications No. 2011-035752, filed Feb. 22, 2011, and No. 2012-035434, filed Feb. 21, 2012, all of which are incorporated by reference in their entities herein. The International application was published in Japanese on Aug. 30, 2012 as International Publication No. WO/2012/115137 under PCT Article 21(2).

FIELD OF THE INVENTION

The present invention relates to a composite soft magnetic material having low magnetostriction (magnetic strain) and a high magnetic flux density, which is used as a raw material for electromagnetic circuit components such as a motor, an actuator, a reactor, a transformer, a choke core, a magnetic sensor core, a noise filter, a switching power supply, and a DC/DC converter, a method for producing the same, and an electromagnetic circuit component.

BACKGROUND OF THE INVENTION

In the related art, as materials for magnetic cores of a motor, an actuator, a magnetic sensor, and the like, soft magnetic sintered materials are known which may be obtained by sintering an iron powder, an iron-based Fe—Al soft magnetic alloy powder, an iron-based Fe—Ni soft magnetic alloy powder, an iron-based Fe—Cr soft magnetic alloy powder, an iron-based Fe—Si soft magnetic alloy powder, an iron-based Fe—Si—Al soft magnetic alloy powder, an iron-based Fe—Co soft magnetic alloy powder, an iron-based Fe—Co—V soft magnetic alloy powder, and an iron-based Fe—P soft magnetic alloy powder (hereinafter, these are collectively referred to as soft magnetic particles).

On the other hand, in the case where an iron powder or an alloy powder is produced through powderization by a gas atomization method or a water atomization method, the iron powder or the alloy powder has a low specific resistance in an elementary substance state. Therefore, the following countermeasures have been taken. A surface of the iron powder or the alloy powder is coated with an insulating film or the powder is mixed with an organic compound or an insulating material; and thereby, sintering is prevented so as to increase the specific resistance. With regard to this kind of soft magnetic material, a composite soft magnetic material is suggested so as to suppress eddy current loss, and in the composite soft magnetic material, a surface of a soft magnetic particle including iron is coated with a lower layer film formed from a nonferrous metal and an insulating film including an inorganic compound.

As an example of the composite soft magnetic material, a powder magnetic core has been adapted. The powder magnetic core is obtained as follows. A composite soft magnetic material is obtained by mixing a soft magnetic powder and an insulating binder. The composite soft magnetic material is subjected to compression molding into a target shape, and the resultant compression-molded body is baked This powder magnetic core has a structure in which soft magnetic powder particles are bonded to each other through the insulating binder; and thereby, insulation between the soft magnetic powder particles is secured by the insulating binder.

In addition, with regard to an example of the powder magnetic core, there is disclosed a technology in which a silicone-based resin as a resin having an operation of reducing a magnetostriction amount is added to an Fe—Si alloy powder (the content of Si is in a range of 0.5% by mass to 3.5% by mass) to obtain a low magnetostrictive material (refer to Patent Document 1).

In addition, with regard to the kind of soft magnetic material, there is disclosed a technology of obtaining a high-strength and low magnetostrictive material. In the technology, a pure iron powder and an Fe-6.5 Si alloy powder are mixed, and kaolin, amorphous silica, an acrylic emulsion, and a lubricant are further added to the resultant mixture in such a manner that a weight ratio of an amount of the pure iron powder to the total amount becomes in a range of 10% to 55% (refer to Patent Document 2).

However, with regard to electromagnetic components for electronic apparatuses, along with miniaturization and high performance of the electronic apparatuses, relatively strict material properties are demanded, and it is necessary for the electromagnetic components not to cause a problem in a practical use. When an examination is made with respect to soft magnetic material that is used for these components, in the low magnetostrictive material that is obtained by mixing the pure iron powder and the Fe-6.5 Si alloy powder, further adding the kaolin, the amorphous silica, and the like to the resultant mixture as described above, and subjecting the resultant mixture to compression molding, and in an iron-based soft magnetic material other than an Ni—Fe alloy (Permalloy in which the content of Ni is 78.5% by weight) or an Fe—Si—Al (Sendust) alloy, a problem occurs in use in which noise is caused by magnetostriction, particularly, in a frequency range of 10 kHz or less. Therefore, there is a problem in that the soft magnetic materials are not suitable in a practical use.

Accordingly, with regard to this kind of the iron-based soft magnetic material, it is desired that a soft magnetic material is provided which has a low magnetostrictive property and a high magnetic flux density, and with the low magnetostrictive property, noise caused by magnetostriction does not occur in a practical use state.

PRIOR ART DOCUMENT

Patent Document

Patent Document 1: Japanese Unexamined Patent Application, First Publication No. 2006-332328

Patent Document 2: Japanese Unexamined Patent Application, First Publication No. 2008-192897

SUMMARY OF THE INVENTION

Problems to be Solved by the Invention

The present invention has been made in consideration of the above-described problems, and an object thereof is to provide an iron-based composite soft magnetic material having a low magnetostrictive property and capable of being used in a wide frequency range. In concrete, an appropriate amount of an Fe—Si alloy powder including Si of 11% by mass to 16% by mass is mixed with a pure iron-based composite soft magnetic powder so as to mix an Fe—Si alloy powder having a specific composition as an appropriate amount of a negative magnetostrictive material that mitigates positive magnetostriction of the pure iron-based composite soft magnetic powder, and then a heat treatment is carried out; and thereby, the iron-based composite soft magnetic material is provided.

Means for Solving the Problems

To accomplish the above-described object, aspects of the present invention have the following features.

(1) There is provided a composite soft magnetic material having low magnetostriction and high magnetic flux density, which includes: pure iron-based composite soft magnetic powder particles that are subjected to an insulating treatment by a Mg-containing insulating film or a phosphate film; and Fe—Si alloy powder particles including 11% by mass to 16% by mass of Si in such a manner that a ratio of an amount of the Fe—Si alloy powder particles to a total amount of both of the particles is in a range of 10% by mass to 60% by mass, wherein a boundary layer is included between the particles.

(2) The composite soft magnetic material having low magnetostriction and high magnetic flux density according to (1), wherein a film thickness of the Mg-containing insulating film is in a range of 5 nm to 200 nm.

(3) The composite soft magnetic material having low magnetostriction and high magnetic flux density according to (2), wherein the composite soft magnetic material is manufactured by a method which includes: mixing a pure iron-based composite soft magnetic powder that is subjected to the insulation treatment by the Mg-containing insulation film and is prepared for forming the pure iron-based composite soft magnetic powder particles, and an Fe—Si alloy powder that is prepared for forming the Fe—Si alloy powder particles; subjecting a resultant mixture to compression molding; and subjecting a resultant molded body to a heat treatment.

(4) The composite soft magnetic material having low magnetostriction and high magnetic flux density according to any one of (1) to (3), wherein positive magnetostriction of the pure iron-based composite soft magnetic powder particles is mitigated by negative magnetostriction of the Fe—Si alloy powder particles to obtain low magnetostriction in a range of $-2\times10^{-6}$ to $+2\times10^{-6}$ with a magnetic flux density in a range of 0 T to 0.5 T.

(5) The composite soft magnetic material having low magnetostriction and high magnetic flux density according to any one of (1) to (4), wherein a methyl-based silicone resin, a methylphenyl-based silicone resin, or a phenyl-based silicone resin is added and mixed in addition to the pure iron-based composite soft magnetic powder and the Fe—Si alloy powder, and then the resultant mixture is subjected to the heat treatment, and thereby, the composite soft magnetic material is manufactured.

(6) The composite soft magnetic material having low magnetostriction and high magnetic flux density according to any one of (1) to (5), wherein the boundary layer, which consists of a baked material of a methyl-based silicone resin, a methylphenyl-based silicone resin, or a phenyl-based silicone resin, is generated at an interface between the pure iron-based composite soft magnetic powder particles and the Fe—Si alloy powder particles.

(7) There is provided an electromagnetic circuit component which includes: the composite soft magnetic material having low magnetostriction and high magnetic flux density according to any one of (1) to (6).

(8) There is provided a method for producing a composite soft magnetic material having low magnetostriction and high magnetic flux density which includes: mixing a pure iron-based composite soft magnetic powder that is subjected to an insulating treatment by a Mg-containing insulating film, and an Fe—Si alloy powder including 11% by mass to 16% by mass of Si in such a manner that a ratio of an amount of the Fe—Si alloy powder to a total amount after the mixing becomes in a range of 10% by mass to 60% by mass; subjecting a resultant mixture to compression molding; and subjecting a resultant molded body to a baking treatment at a temperature of 500° C. to 1,000° C. in a non-oxidizing atmosphere.

(9) There is provided a method for producing composite soft magnetic material having low magnetostriction and high magnetic flux density which includes: mixing a pure iron-based composite soft magnetic powder that is subjected to an insulating treatment by a phosphate film, and an Fe—Si alloy powder including 11% by mass to 16% by mass of Si in such a manner that a ratio of an amount of the Fe—Si alloy powder to a total amount after the mixing becomes in a range of 10% by mass to 60% by mass; subjecting a resultant mixture to compression molding; and subjecting a resultant molded body to a baking treatment at a temperature of 350° C. to 500° C. in a non-oxidizing atmosphere.

(10) The method for producing a composite soft magnetic material having low magnetostriction and high magnetic flux density according to (8), wherein a Mg-containing insulating film having a film thickness of 5 nm to 200 nm is used as the Mg-containing insulating film.

(11) The method for producing a composite soft magnetic material having low magnetostriction and high magnetic flux density according to any one of (8) to (10), wherein a methyl-based silicone resin, a methylphenyl-based silicone resin, or a phenyl-based silicone resin is added and mixed in addition to the pure iron-based composite soft magnetic powder and the Fe—Si alloy powder, the resultant mixture is subjected to the compression molding, and the resultant molded body is subjected a heat treatment, and thereby, a boundary layer is generated, which consists of a baked material of the methyl-based silicone resin, the methylphenyl-based silicone resin, or the phenyl-based silicone resin, at an interface between pure iron-based composite soft magnetic powder particles and Fe—Si alloy powder particles.

Effects of the Invention

According to an aspect of the composite soft magnetic material having low magnetostriction and high magnetic flux density of the present invention, the composite soft magnetic material contains: pure iron-based composite soft magnetic powder particles that are subjected to an insulating treatment by a Mg-containing insulating film or a phosphate film; and Fe—Si alloy powder particles including 11% by mass to 16% by mass of Si in such a manner that a ratio of an amount of the Fe—Si alloy powder particles to a total amount of both of the particles is in a range of 10% by mass to 60% by mass. In addition, a boundary layer is included between the particles. Accordingly, the composite soft magnetic material can have low magnetostriction that is mitigated as a whole due to pairing of the positive magnetostriction of the pure iron-based composite soft magnetic powder particles and the negative magnetostriction of the Fe—Si alloy powder particles including 11% by mass to 16% by mass of Si.

In addition, a bonding state between powders due to the compression molding can be satisfactory by mixing of the pure iron-based composite soft magnetic powder that is soft and the hard Fe—Si alloy powder. Therefore, even when a compression power during the compression molding is small, a composite soft magnetic material which has low magnetostriction and in which a bonding property between powders is excellent can be realized compared to the case of subjecting hard powders to compression molding. Accordingly, a burden imposed on a molding machine can be reduced, and thus a molding machine with a small compression power can be used compared to the case of subjecting hard powders to compression molding.

The pure iron-based composite soft magnetic powder particles or the Fe—Si alloy powder particles are bonded through a boundary layer, and boundary layer is formed by subjecting a methyl-based silicone resin, a methylphenyl-based silicone resin, or a phenyl-based silicone resin to compression molding and then subjecting the resultant molded body to a baking treatment. Therefore, mechanical bonding power at a boundary layer portion is excellent. In addition, even in a grain boundary portion of the pure iron-based composite soft magnetic powder particles and the Fe—Si alloy powder particles, reliable insulation can be expected. Accordingly, a composite soft magnetic material with low iron loss in a high-frequency region can be obtained.

According to one aspect of the composite soft magnetic material having low magnetostriction and high magnetic flux density of the present invention, low magnetostriction and high magnetic flux density can be compatible with each other. Accordingly, the composite soft magnetic material can be used as a material of various kinds of electromagnetic circuit components utilizing this characteristic.

The electromagnetic circuit components constituted by using the composite soft magnetic material having low magnetostriction and high magnetic flux density may be used, for example, as a magnetic core, an electric motor core, a power generator core, a solenoid core, an ignition core, a reactor core, a transformer core, a choke coil core, a magnetic sensor core, or the like. With regard to all of the components, electromagnetic circuit components capable of exhibiting excellent magnetic properties can be provided.

In addition, examples of electric apparatuses to which the electromagnetic circuit component is assembled include an electric motor, a power generator, a solenoid, an injector, an electromagnetic drive valve, an inverter, a converter, a transformer, a relay, a magnetic sensor system, and the like, and the present invention has an effect of contributing to high efficiency and high performance, or reduction in size and weight of these electric apparatuses.

DETAILED DESCRIPTION OF THE INVENTION

Best Mode for Carrying Out the Invention

Hereinafter, the present invention will be described in detail, but the present invention is not limited to the following embodiment.

Figure 1:
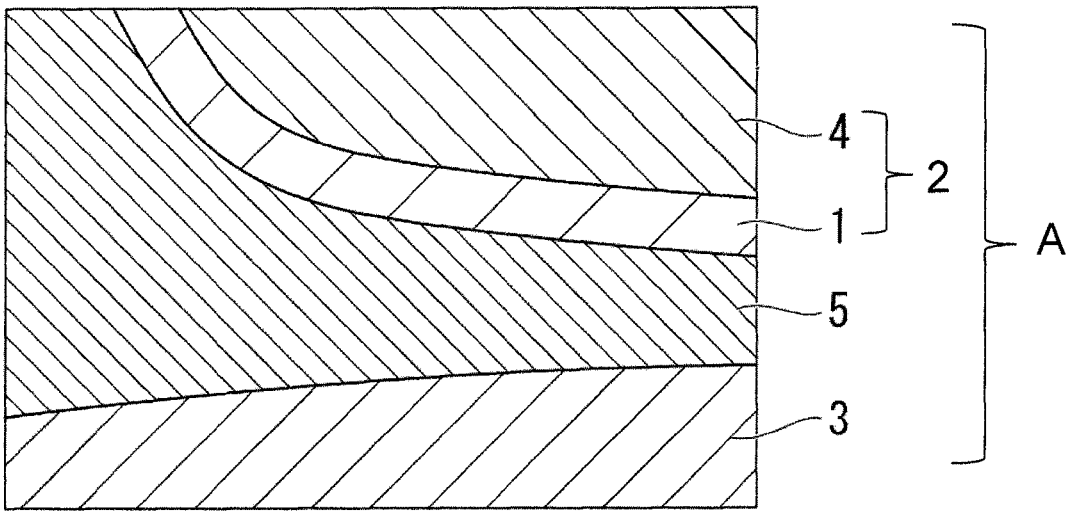
FIG. 1 is a schematic diagram illustrating a partial structure of a composite soft magnetic material having low magnetostriction and high magnetic flux density related to an aspect of the present invention.

FIG. 1 shows a schematic diagram illustrating an example of a structure configuration of a composite soft magnetic material having low magnetostriction and high magnetic flux density of a first embodiment related to an aspect of the present invention. A composite soft magnetic material A having low magnetostriction and high magnetic flux density of this embodiment mainly includes: a plurality of pure iron-based composite soft magnetic powder particles 2 that are subjected to an insulation treatment by a Mg-containing insulating film 1 having a film thickness of 5 nm to 200 nm; a plurality of Fe—Si alloy powder particles 3 including 11% by mass to 16% by mass of Si; and a boundary layer 5 formed to be present at an interface between a plurality of particles. The composite soft magnetic powder particle 2 is constituted by covering the outer periphery (outer surface) of pure iron powder particle 4 with the Mg-containing insulating film 1.

In FIG. 1, a part of a structure of the composite soft magnetic material A having low magnetostriction and high magnetic flux density related to an aspect of the present invention is shown in an enlarged manner; and therefore, only one of the pure iron-based composite soft magnetic powder particles 2 and one of the Fe—Si alloy powder particles 3 are drawn. However, as described later, the composite soft magnetic material A having low magnetostriction and high magnetic flux density is formed by mixing a plurality of pure iron-based composite soft magnetic powders and a plurality of Fe—Si alloy powders, subjecting the resultant mixture to compression molding, and subjecting the resultant molded body to a heat treatment. Therefore, an actual composite soft magnetic material A having low magnetostriction and high magnetic flux density has a structure in which the plurality of pure iron-based composite soft magnetic powder particles 2 and the plurality of Fe—Si alloy powder particles 3 are bonded to each other through the boundary layer 5 present therebetween. In addition, the composite soft magnetic powder particles 2 which are subjected to the insulation treatment by the Mg-containing insulating film may be substituted with pure iron-based composite soft magnetic powder particles which are subjected to the insulation treatment by a phosphate film such as a zinc phosphate film, an iron phosphate film, a manganese phosphate film, and a calcium phosphate film, and description thereof will be made later.

Hereinafter, description will be made with respect to a pure iron-based composite soft magnetic powder that forms the pure iron-based composite soft magnetic particles 2, and the pure iron-based composite soft magnetic particles 2 are formed by subjecting the pure iron powder particles 4 to the insulation treatment by the Mg-containing insulating film 1 having a film thickness of 5 to 200 nm.

It is preferable that the pure iron-based composite soft magnetic powder mainly include a pure iron powder having an average particle size (D50) in a range of 5 μm to 500 μm. The reason is as follows. In the case where the average particle size is smaller than 5 μm, compressibility of the pure iron powder decreases, and a volume ratio of the pure iron powder decreases; and as a result, there is a tendency that a magnetic flux density value decreases. On the other hand, in the case where the average particle size is larger than 500 μm, an eddy current inside the pure iron powder increases; and thereby, permeability in a high frequency decreases.

In addition, the average particle size of the pure iron-based composite soft magnetic powder is a particle size that may be obtained by measurement according to a laser diffraction method.

A pure iron-based composite soft magnetic powder in which a surface of the pure iron powder is coated with the Mg-containing insulating material can be obtained by the following method. The pure iron powder is used as a raw material powder, and the pure iron powder is subjected to an oxidizing treatment in which the pure iron powder is held in an oxidizing atmosphere at a temperature of room temperature to 500° C. A Mg powder is added to the raw material powder, and the resultant mixture is mixed to obtain a mixed powder. The mixed powder is heated at a temperature of approximately 150° C. to 1,100° C. in an inert gas atmosphere or a vacuum atmosphere having a pressure of approximately $1\times10^{-12}$ MPa to $1\times10^{-1}$ MPa. The mixed powder may be further heated at a temperature of 50° C. to 400° C. in an oxidizing atmosphere as necessary.

An added amount of the Mg powder is preferably in a range of 0.1% by mass to 0.3% by mass.

The pure iron-based composite soft magnetic powder coated with the Mg-containing insulating film 1 is greatly excellent in adhesiveness compared to a conventional soft magnetic powder coated with a Mg-containing insulating material in which a Mg ferrite film is formed. Accordingly, even when a green compact is produced by subjecting the pure iron-based composite soft magnetic powder coated with the Mg-containing insulating film 1 to compression molding, the insulating film is less breakable and is less peeled off. In addition, in the composite soft magnetic material that is obtained by subjecting the green compact of the pure iron-based composite soft magnetic powder coated with the Mg-containing insulating film 1 to heat treatment at a temperature of approximately 400° C. to 1,300° C., a structure is obtained in which a Mg-containing oxide film is uniformly distributed in a grain boundary.

In the case of the above-described production method, the pure iron powder subjected to the oxidation treatment is used as the raw material powder, and the Mg powder is added to the raw material powder. The resultant mixture is mixed to obtain the mixed powder. The mixed powder is heated at a temperature of 150° C. to 1,100° C. in an inert gas atmosphere or a vacuum atmosphere having a pressure of $1\times10^{-12}$ MPa to $1\times10^{-1}$ MPa. During the heating, it is preferable that the mixed powder be heated while being allowed to roll.

The Mg-containing insulating film 1 that is used in this embodiment represents a film of a Mg-containing insulating material that is deposited on a surface of the pure iron powder, and the film of the Mg-containing insulating material is deposited by reacting iron oxide (Fe—O) of the pure iron powder and Mg with each other. The film thickness of the Mg-containing insulating film (Mg—Fe—O ternary oxide deposition film) that is formed on the surface of the pure iron powder is preferably in a range of 5 nm to 200 nm in order to obtain a high magnetic flux density and a high specific resistance of the composite soft magnetic material after the compression molding.

Here, in the case where the film thickness is thinner than 5 nm, the specific resistance of the composite soft magnetic material that is obtained after the compression molding and the heat treatment is not sufficient, and the eddy current loss increases. Therefore, the film thickness of thinner than 5 nm is not preferable. In the case where the film thickness exceeds 200 nm, there is a tendency that the magnetic flux density of the compression-molded composite soft magnetic material decreases. In this range, the film thickness is more preferably in a range of 5 nm to 100 nm.

With regard to an Fe—Si alloy including 11% by mass to 16% by mass of Si, in general, a solid solubility limit of Si with respect to iron at which magnetic properties can be obtained stably is approximately 21% by mass. Within this range, with regard to a single crystal of the Fe—Si alloy, it is known that Fe-3Si shows positive magnetostriction and Fe-6.5Si shows zero magnetostriction. However, with regard to a compacted powder material obtained by subjecting the Fe—Si alloy powder to compression molding and a heat treatment, it is not clear that the magnetostriction becomes positive magnetostriction, zero magnetostriction, or negative magnetostriction with what extent of Si content.

The present inventors considered that the above-described pure iron-based composite soft magnetic powder coated with the Mg-containing insulating film 1 has positive magnetostriction, and the pure iron-based composite soft magnetic powder is softer than the Fe—Si alloy powder. In view of these, the present inventors assumed as follows. In the case where the hard Fe—Si alloy powder that shows negative magnetostriction and the pure iron-based composite soft magnetic powder that shows positive magnetostriction and that is soft are mixed, and the resultant mixture is subjected to compression molding, it is possible to conduct compression molding to attain a high density and excellent adhesiveness without increasing a molding pressure compared to the case where a single substance of this kind of alloy powder is subjected to compression molding, and magnetostriction of a green compact can be also made small as a whole. The present inventors have performed research on the basis of this assumption. As a result, they have accomplished the present invention.

The present inventors subjected a mixture of the Fe—Si alloy powder and the pure iron-based composite soft magnetic powder coated with the Mg-containing insulation film 1 to compression molding and a heat treatment, The present inventors have performed research for the magnetostriction with respect to a composite soft magnetic material that was obtained by subjecting a mixture of the Fe—Si alloy powder and the pure iron-based composite soft magnetic powder coated with the Mg-containing insulation film 1 to compression molding and a heat treatment. As a result, they have found that even in the case where a composite soft magnetic material was molded using an Fe-3Si alloy powder, an Fe-8Si alloy powder, or an Fe-10Si alloy powder, magnetostriction did not become low magnetostriction in a range of $-2\times10^{-6}$ to $+2\times10^{-6}$ as a whole with a magnetic flux density in a range of 0 T to 0.5 T.

Therefore, the present inventors have performed various kinds of research using Fe—Si alloy powders in which the contents of Si were further increased so as to realize negative magnetostriction while referring to the composition of Fe-6.5 Si as a boundary value, and Fe-6.5Si is known as the composition of a common Fe—Si alloy single crystal with which magnetostriction becomes 0 ppm. As result, they have found a preferable range of the content of Si, and they have applied this range to the present invention.

From this background, in this embodiment, an Fe—Si alloy powder including 11% by mass to 16% by mass of Si is used as the Fe—Si alloy powder that is mixed with the pure iron-based composite soft magnetic powder coated with the Mg-containing insulating film 1.

With regard to the content of Si contained in the Fe—Si alloy powder, it is considered that in general, a solid solubility limit of Si with respect to Fe is 21% by mass in an aspect in which magnetism is obtained stably. In the case where Si is included at a content of more than 14.5% by mass in view of this solid solubility limit of Si, there is a tendency that magnetism becomes unstable. Therefore, when the Fe—Si alloy powder is mixed with the pure iron-based composite soft magnetic powder coated with the Mg-containing insulating film 1 and then the resultant mixture is subjected to compression molding, it is difficult to obtain a high magnetic flux density. The reason is considered as follows. In the Fe—Si alloy, a ferromagnetic $\alpha$-phase is a main phase in the case where the content of Si is in a range of 14.5% by mass or less. However, in the case where the content of Si exceeds 14.5% by mass, an amount of a nonmagnetic $\epsilon$-phase gradually increases along with an increase in the content of Si, and the magnetic flux density is affected by this increase.

Therefore, it is necessary to set the content of Si contained in the Fe—Si alloy powder to be in a range of 11% by mass to 16% by mass so as to realize low magnetostriction in a range of $-2\times10^{-6}$ to $+2\times10^{-6}$ as a whole with a magnetic flux density in a range of 0 T to 0.5 T by mixing the Fe—Si alloy powder showing the negative magnetostriction against the positive magnetostriction shown by the pure iron-based composite soft magnetic powder.

In addition, with regard to a particle size of the Fe—Si based alloy powder, it is preferable to use a powder having an average particle size (D50) in a range of 50 μm to 150 μm as a main component. In addition, the average particle size of the Fe—Si based alloy powder represents a particle size that is obtained by measurement according to a laser diffraction method.

Next, with regard to a mixing ratio between the pure iron-based composite soft magnetic powder coated with the Mg-containing insulating film 1 and the Fe—Si alloy powder, it is necessary to set the ratio of an amount of the pure iron-based composite soft magnetic powder to the total amount of the pure iron-based composite soft magnetic powder and the Fe—Si alloy powder to be in a range of 40% by mass to 90% by mass. In the case where the amount of the pure iron-based composite soft magnetic powder is too small, it is less likely to exhibit the high magnetic flux density which is originally derived from the pure iron. In addition, a proportion of the pure iron-based composite soft magnetic powder, which is soft, is smaller than that of the hard Fe—Si alloy powder. Therefore, a molding pressure for satisfactory compression molding increases, and thus there is a tendency that a burden is imposed on a molding machine. Conversely, in the case where the proportion of the Fe—Si alloy powder showing the negative magnetostriction is too small, it is difficult to adjust the positive magnetostriction which is derived from the pure iron-based composite soft magnetic powder; and thereby, magnetostriction increases.

In order to obtain satisfactory magnetic properties (saturated magnetic flux density) by balancing the magnetostriction so as to realize low magnetostriction, a ratio of an amount of the pure iron-based composite soft magnetic powder particles 2 to the total amount of the pure iron-based composite soft magnetic powder and the Fe—Si alloy powder is preferably in a range of 40% by mass to 90% by mass. In addition, in this range, in the case where the ratio is set to be in a range of 40% by mass to 80% by mass, the magnetostriction further decreases, and thus this range is preferable.

Hereafter, description will be made with respect to an example of a method for producing composite soft magnetic material having low magnetostriction and high magnetic flux density which has a structure configuration shown in FIG. 1.

In the case of producing the composite soft magnetic material having low magnetostriction and high magnetic flux density, for example, a pure iron powder that is prepared in a first process as a raw material is subjected to pre-oxidization in a second process to oxidize a surface of the pure iron powder, and Mg is deposited in a third process to prepare the pure iron-based composite soft magnetic powder coated with the Mg-containing insulating film. Next, a silicone resin is added to this powder and the resultant mixture is dried to obtain a dry powder. In a fourth process, an Fe—Si alloy powder that is obtained separately by adding a silicone resin and drying, and the pure iron-based composite soft magnetic powder that is obtained by adding the silicone resin and drying in the above-described manner are mixed. Then, the resultant mixture is molded into a desired shape in a fifth process, and the resultant molded body is subjected to a baking treatment in a sixth process. Thereby, the above-described composite soft magnetic material A having low magnetostriction and high magnetic flux density related to this embodiment of the present invention can be obtained.

As a pressure of the molding, a molding pressure of approximately 8 t/cm$^2$ to 12 t/cm$^2$ can be selected. The molding pressure that is used here is much smaller than a value of 20 t/cm$^2$ class necessary for compression molding of Fe—Si—Al based Sendust alloy powder that is known as a general hard alloy or compression molding of Fe-6.5Si alloy powder. The molding pressure is approximately the same as a pressure used in a general powder molding method. Accordingly, excellent composite soft magnetic material A having low magnetostriction and high magnetic flux density related to this embodiment can be produced using a powder molding machine with a typical size.

After the compression molding, the obtained molded body is baked at a temperature of 500° C. to 1,000° C., preferably, in a non-oxidation atmosphere such as in vacuum or in a nitrogen atmosphere for approximately several tens of minutes; and thereby, the composite soft magnetic material A having low magnetostriction and high magnetic flux density can be obtained.

In addition, the reason why the baking can be carried out at such a high temperature is that the composite soft magnetic powder coated with the Mg-containing insulating film 1 is used. For example, in the case where a zinc phosphate film or the like is coated, insulation of the zinc phosphate film is completely broken by baking in this high temperature region. Since the baking can be carried out at a high temperature of 500° C. or higher, a crystal grain of a baked material can be made large, and thus this is preferable for improvement of magnetic properties. However, in this embodiment, the pure iron-based composite soft magnetic powder coated with the phosphate film can be also used. Therefore, in the case of using the phosphate film, it is preferable to carry out the baking at a temperature of approximately 350° C. to 500° C. In addition, the composite soft magnetic powder particles 2 that are subjected to the insulating treatment by the Mg-containing insulating film can be substituted with pure iron-based composite soft magnetic powder particles that are subjected to the insulating treatment by a phosphate film, for example, a zinc phosphate film, an iron phosphate film, a manganese phosphate film, or a calcium phosphate film.

The composite soft magnetic material A having low magnetostriction and high magnetic flux density that is produced as described above exhibits excellent magnetic properties in which magnetostriction is in a range of $-2\times10^{-6}$ to $+2\times10^{-6}$ that is low magnetostriction with a magnetic flux density in a range of 0 T to 0.5 T, and a saturated magnetic flux density (a magnetic flux density at 10 kA/m) is in a range of 0.8 to 1.2 T.

In addition, the pure iron-based composite soft magnetic powder particles 2 mainly serve for magnetism and have a high saturated magnetic flux density. The pure iron-based composite soft magnetic powder particles 2 are insulated by the Mg-containing insulating film 1, and further insulated by the boundary layer 5. In addition, the pure iron-based composite soft magnetic powder particles 2 are in a densely bonded state through baking. Accordingly, iron loss in a high-frequency area (high-frequency region such as 50 KHz) is made small; and therefore, an excellent soft magnetic property is provided.

In addition, in the composite soft magnetic material A having low magnetostriction and high magnetic flux density of this embodiment, the Fe—Si alloy powder particles 3, which are also excellent from an aspect of a high-frequency correspondence, are strongly bonded at the boundary layer 5, and a specific resistance is also high. Accordingly, there is provided a characteristic in which iron loss in a high-frequency region such as 50 KHz is small.

Figure 2:
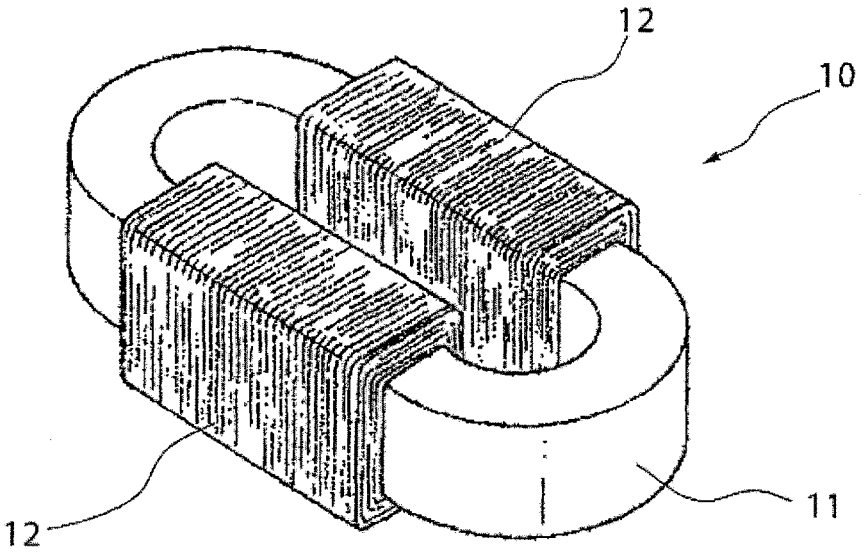
FIG. 2 is a perspective diagram illustrating an example of an electromagnetic circuit component constituted by using a composite soft magnetic material having low magnetostriction and high magnetic flux density related to an aspect of the present invention.

FIG. 2 shows a reactor that is an example of an electromagnetic circuit component to which the composite soft magnetic material A having low magnetostriction and high magnetic flux density related to one aspect of the present invention is applied.

The reactor 10 shown in FIG. 2 includes a racetrack-shaped reactor core 11 in a plan view, and two coils 12 wound around the reactor core 11.

As shown in FIG. 2, each of the coils 12 consists of a conductive wire wound plural times, and the coil is wound around a longitudinal linear section of the reactor core 11. In the reactor 10, the reactor core 11 includes the composite soft magnetic material A having low magnetostriction and high magnetic flux density.

In the reactor 10 of this example, the specific resistance of the reactor core 11 is large, and magnetostriction is suppressed to be small. Accordingly, a high performance as the reactor 10 can be obtained. Particularly, the reactor 10 of this example has low magnetostriction; and therefore, noise caused by the magnetostriction is less likely to occur.

In addition, the reactor 10 is an example in which the composite soft magnetic material A having low magnetostriction and high magnetic flux density related to this embodiment is applied to an electromagnetic circuit component. Of course, the composite soft magnetic material A having low magnetostriction and high magnetic flux density related to this embodiment can be applied to various electromagnetic circuit components in addition to the reactor 10.

EXAMPLES

A pure iron powder having an average particle size (D50) of 100 μm was subjected to a heat treatment in the air at 250° C. for 30 minutes. Here, an amount of a MgO film is proportional to the thickness of an oxide film generated at the heating treatment of the previous stage at 250° C. in the air; and therefore, an added amount of Mg may be a requisite minimum. 0.3% by mass of Mg powder was mixed with the iron powder, and this mixed powder was heated in a vacuum atmosphere having a pressure of 0.1 Pa at 650° C. by a batch-type rotary kiln while being allowed to roll. Thereby, a pure iron-based soft magnetic powder coated with Mg—Fe—O ternary oxide deposition film (pure iron-based soft magnetic powder coated with a Mg-containing insulating material) was produced.

The film thickness of the Mg—Fe—O ternary oxide deposition film containing (Mg, Fe)O that was formed on a surface of the pure iron-based soft magnetic powder coated with the Mg-containing insulating material is proportional to the thickness of the oxide film generated by the above-described heating treatment in the air, and the film thickness can be controlled according to a heat treatment time.

Whether or not the Mg-containing insulating film having a film thickness of 5 nm to 200 nm was present on the surface of the plurality of pure iron-based composite soft magnetic powder particles was confirmed by the following SEM-EDS (field emission-type scanning electron microscope) analysis. "SEM-EDS: Ultra55 manufactured by Carl Zeiss, EDS software: Noran System Six" observation conditions: an acceleration voltage was 1 kV, and EDS surface analysis conditions: an acceleration voltage was 4 kV, an amount of current was 1 nA, and WD was 3 mm.

Next, 0.4% by mass of methylphenyl-based silicone resin was added to the pure iron-based composite soft magnetic powder coated with the Mg-containing insulating film, and the resultant mixture was dried. Thereby, a pure iron-based composite soft magnetic powder coated with the silicone resin was prepared.

An Fe-14 Si alloy powder (an average particle size (D50) according to a laser diffraction method: 80 μm) was prepared, and 0.3% by mass of a silane coupling agent and 2% by mass of a methyl-based silicone resin were added to the alloy powder to obtain a powder (hereinafter, referred to as a powder N) The obtained powder N and the pure iron-based composite soft magnetic powder (hereinafter, referred to as a powder P) coated with the methylphenyl-based silicone resin were mixed at a ratio of the powder N: the powder P=60:40, 50:50, 40:60, 30:70, 20:80, and 10:90, and the resultant mixtures were molded using a molding machine at a pressure of 12 t/cm$^2$ and at an ordinary temperature. Then, the resultant molded bodies were baked in a nitrogen atmosphere at 650° C. for 30 minutes to obtain composite soft magnetic materials having low magnetostriction and high magnetic flux density having a ring shape (OD35×ID25×H5 mm) or a bar shape (60×10×H5 mm).

In addition, with regard to the silicone resin coated on the surface of the pure iron-based composite soft magnetic powder, partial components disappear due to the baking. However, Si remains as a main component, and Si constitutes a boundary layer at a grain boundary between pure iron-based composite soft magnetic powder particles and Fe—Si alloy powder particles.

With regard to the composite soft magnetic materials having low magnetostriction and high magnetic flux density that were obtained, magnetostriction at a magnetic flux density of 0.5 T and a magnetic flux density (saturated magnetic flux density) at a magnetic field of 10 kA/m were measured, respectively.

In addition, composite soft magnetic materials having low magnetostriction and high magnetic flux density were prepared in the same manner as the above-described example except that an Fe-10.5 Si alloy powder, an Fe-11 Si alloy powder, an Fe-12Si alloy powder, an Fe-16Si alloy powder, and an Fe-16.5Si alloy powder were used in place of the previous Fe-14Si alloy powder as the Fe—Si alloy powder that was used, and magnetostriction at a magnetic flux density of 0.5 T and a magnetic flux density at a magnetic field of 10 kA/m were measured, respectively.

The measurement of the magnetic flux density at 10 kA/m was carried out using a ring-shaped sample by a B-H tracer (DC magnetization measuring device B integration unit TYPE 3257, manufactured by Yokogawa Electric Corporation). In addition, the measurement of magnetostriction was carried out as follows.

The measurement of magnetostriction was carried out by a strain gauge method. When a magnetic field is applied to a sample to which a strain gauge is attached, electrical resistance of the gauge varies. The strain gauge method is a method of measuring a strain amount of the sample by utilizing that variation in electrical resistance. In the present example, a bar-shape sample was cut to obtain a sample having the size of 10×10×H5 mm. A strain gauge (manufactured by Kyowa Electronic Instruments Co., Ltd.) was bonded to the sample using an adhesive. The measurement of the sample was carried out after at least one hour passed from the bonding using the adhesive. In addition, in the magnetostriction measurement of the present example, a magnetic field was applied using a B—H tracer (DC magnetization property automatic recording device BHH-50 manufactured by Riken Denshi Co., Ltd., and electromagnet TEM-VW101C-252 manufactured by TOEI INDUSTRY CO., LTD.), and recording was carried out using a PC-link type high-function recorder GR-3500 manufactured by KEYENCE CORPORATION.

Results of the above-described measurement are shown in Tables 1 to 3.

TABLE 1

| Positive magnetostriction material powder P | Mixing ratio (% by mass) | Negative magnetostriction material powder N | Mixing ratio (% by mass) | Magnetostriction at 0.5 T ($\times 10^{-6}$) | Saturated magnetic flux density at 10 kA/m B10 kA/m (T) | Strength (MPa) |
|---|---|---|---|---|---|---|
| Iron powder coated with MgO | 40 | Fe—11Si | 60 | −1.15 | 0.8 | 30 |
| Iron powder coated with MgO | 40 | Fe—12Si | 60 | −1.31 | 0.8 | 30 |
| Iron powder coated with MgO | 40 | Fe—14Si | 60 | −1.45 | 0.8 | 30 |
| Iron powder coated with MgO | 50 | Fe—14Si | 50 | −0.48 | 0.8 | 33 |
| Iron powder coated with MgO | 60 | Fe—14Si | 40 | 0.78 | 1.0 | 37 |
| Iron powder coated with MgO | 70 | Fe—14Si | 30 | 1.10 | 1.0 | 40 |
| Iron powder coated with MgO | 80 | Fe—14Si | 20 | 1.46 | 1.1 | 44 |
| Iron powder coated with MgO | 90 | Fe—14Si | 10 | 1.88 | 1.2 | 49 |
| Iron powder coated with MgO | 50 | Fe—16Si | 50 | 1.56 | 0.7 | 32 |

TABLE 2

| Positive magnetostriction material powder P | Mixing ratio (% by mass) | Negative magnetostriction material powder N | Mixing ratio (% by mass) | Magnetostriction at 0.5 T ($\times 10^{-6}$) | Saturated magnetic flux density at 10 kA/m B10 kA/m (T) |
|---|---|---|---|---|---|
| Iron powder coated with MgO | 40 | Fe—10.5Si | 60 | 4.82 | 0.8 |
| Iron powder coated with MgO | 50 | Fe—16.5Si | 50 | 6.76 | 0.5 |

TABLE 3

| Positive magnetostriction material powder P | Mixing ratio (% by mass) | Negative magnetostriction material powder N | Mixing ratio (% by mass) | Magnetostriction at 0.5 T ($\times 10^{-6}$) | Saturated magnetic flux density at 10 kA/m B10 kA/m (T) |
|---|---|---|---|---|---|
| Iron powder coated with MgO | 30 | Fe—12Si | 70 | −2.62 | 0.9 |
| Iron powder coated with MgO | 38 | Fe—14Si | 62 | −2.46 | 0.7 |
| Iron powder coated with MgO | 82 | Fe—14Si | 18 | 1.58 | 1.1 |
| Iron powder coated with MgO | 92 | Fe—14Si | 8 | 2.10 | 1.2 |

As can be seen from the results shown in Tables 1 to 3, in the case where a composite soft magnetic material was produced by using an Fe—Si alloy powder containing 11% by mass to 16% by mass of Si as the Fe—Si alloy powder, a composite soft magnetic material having low magnetostriction can be obtained. As shown in Table 2, the magnetostriction became positive magnetostriction and increased in both of the case of using Fe-10.5 Si alloy powder and the case of using Fe-16.5 Si alloy powder.

In addition, as can be seen from the results shown in Table 3, in the sample in which a ratio of the Fe—Si alloy powder was 70% by mass, negative magnetostriction was large. In the sample in which the ratio was 62% by mass, negative magnetostriction was slightly large and saturated magnetic flux density decreased. In the sample in which the ratio was 18% by mass, positive magnetostriction slightly increased; however, the value was in a range of $-2\times10^{-6}$ to $+2\times10^{-6}$. In addition, it could be also seen that the strengths of the respective samples shown in Table 1 were sufficient for use.

As can be seen from the above-described results, in the case where an Fe—Si alloy powder containing 11% by mass to 16% by mass of Si is used as the Fe—Si alloy powder, the original positive magnetostriction of the pure iron-based composite soft magnetic powder is adjusted; and thereby, the composite soft magnetic material having low magnetostriction can be realized. In addition, it was proved that in the case where the Fe—Si alloy powder is contained at a content in a range of 10% by mass to 60% by mass relative to the total amount with the pure iron-based composite soft magnetic powder, low magnetostriction and high saturated magnetic flux density can be compatible with each other, and furthermore, sufficient strength is also provided. Furthermore, it was proved that in the case where the Fe—Si alloy powder is contained at a content in a range of 20% by mass to 60% by mass, magnetostriction further decreases, and a satisfactory property can be obtained.

When the samples shown in Table 1 were produced, which of the methyl-based silicone resin and the methylphenyl-based silicone resin to be used was decided depending on kinds of the powders. Instead of it, the methylphenyl-based silicone resin was added to both of the negative magnetostriction material powder N and the positive magnetostriction material powder P to form samples, and the test results of the samples are shown in Table 4.

Next, for comparison with these samples, 60% of an iron powder coated with zinc phosphate and 40% of an Fe-14 Si alloy powder were mixed to produce composite soft magnetic materials having low magnetostriction and high magnetic flux density. A methyl-based silicone resin was added to the Fe—Si alloy powder to coat the Fe—Si alloy with the methyl-based silicone resin, and a methylphenyl-based silicone resin was added to the iron powder coated with the zinc phosphate at the same amount as the samples shown in Table 1. In addition, the resultant powder was mixed, and the resultant mixture was molded. When the resultant molded body was baked in a nitrogen atmosphere for 30 minutes, the temperature was set to 450° C. This is because a heat-resistant temperature of the zinc phosphate film is lower than a heat-resistant temperature of the MgO film.

Test results of the obtained samples are shown in the following Table.

TABLE 4

| Positive magnetostriction material powder P | Mixing ratio (% by mass) | Negative magnetostriction material powder N | Mixing ratio (% by mass) | Magnetostriction at 0.5 T ($\times10^{-6}$) | Saturated magnetic flux density at 10 kA/m B10 kA/m (T) | Strength (MPa) |
|---|---|---|---|---|---|---|
| Iron powder coated with MgO | 40 | Fe—11Si | 60 | −1.36 | 0.8 | 32 |
| Iron powder coated with MgO | 40 | Fe—12Si | 60 | −1.51 | 0.8 | 32 |
| Iron powder coated with MgO | 40 | Fe—14Si | 60 | −1.71 | 0.8 | 32 |
| Iron powder coated with MgO | 50 | Fe—14Si | 50 | −0.66 | 0.8 | 38 |
| Iron powder coated with MgO | 60 | Fe—14Si | 40 | 0.96 | 1.0 | 45 |
| Iron powder coated with MgO | 70 | Fe—14Si | 30 | 1.31 | 1.0 | 47 |
| Iron powder coated with MgO | 80 | Fe—14Si | 20 | 1.50 | 1.1 | 51 |
| Iron powder coated with MgO | 90 | Fe—14Si | 10 | 1.96 | 1.2 | 55 |
| Iron powder coated with MgO | 50 | Fe—16Si | 50 | 1.72 | 0.7 | 35 |

TABLE 5

| Positive magnetostriction material powder P | Mixing ratio (% by mass) | Negative magnetostriction material powder N | Mixing ratio (% by mass) | Magnetostriction at 0.5 T ($\times10^{-6}$) | Saturated magnetic flux density at 10 kA/m B10 kA/m (T) | Strength (MPa) |
|---|---|---|---|---|---|---|
| Iron powder coated with zinc phosphate | 40 | Fe—14Si | 60 | −1.56 | 0.8 | 30 |
| Iron powder coated with zinc phosphate | 60 | Fe—14Si | 40 | 0.86 | 1.0 | 35 |
| Iron powder coated with zinc phosphate | 90 | Fe—14Si | 10 | 1.93 | 1.2 | 48 |

As can be understood from results shown in Table 4, in the case where the composite soft magnetic materials having low magnetostriction and high magnetic flux density was produced by using the same kind of silicone resin with respect to the positive magnetostriction material powder and the negative magnetostriction material powder, respectively, the same results as those obtained in Table 1 were obtained. That is, it was proved that in the case where the Fe—Si alloy powder is contained at a content in a range of 10% by mass to 60% by mass relative to the total amount with the pure iron-based composite soft magnetic powder, low magnetostriction and high saturated magnetic flux density can be compatible with each other, and furthermore, sufficient strength is also provided. In addition, from the results shown in Table 4, it can be understood that magnetostriction can be further lowered by setting the content to be in a range of 20% by mass to 60% by mass among the range of 10% by mass to 60% by mass.

As can be seen from the result shown in Table 5, it could be understood that even in the case where an iron powder coated with zinc phosphate was used instead of the iron powder coated with MgO, the composite soft magnetic materials having low magnetostriction and high magnetic flux density could be obtained which exhibited magnetostriction, saturated magnetic flux density, and strength that were same as those of the samples shown in Tables 1 and 4. In addition, the zinc phosphate film has heat resistance inferior to the MgO film; and therefore, the samples shown in Tables 1 to 4 are superior to the samples shown in Table 5 in terms of the heat resistance.

In addition, in Table 3, the sample including 82% by mass of a iron powder coated with MgO and 18% by mass of Fe-14 Si powder is a sample that falls within the range of this embodiment; and therefore, the sample had magnetostriction lower than those of other samples in Table 3, and the sample exhibited substantially the same saturated magnetic flux density as those of the samples shown in Table 1.

Figure 3:
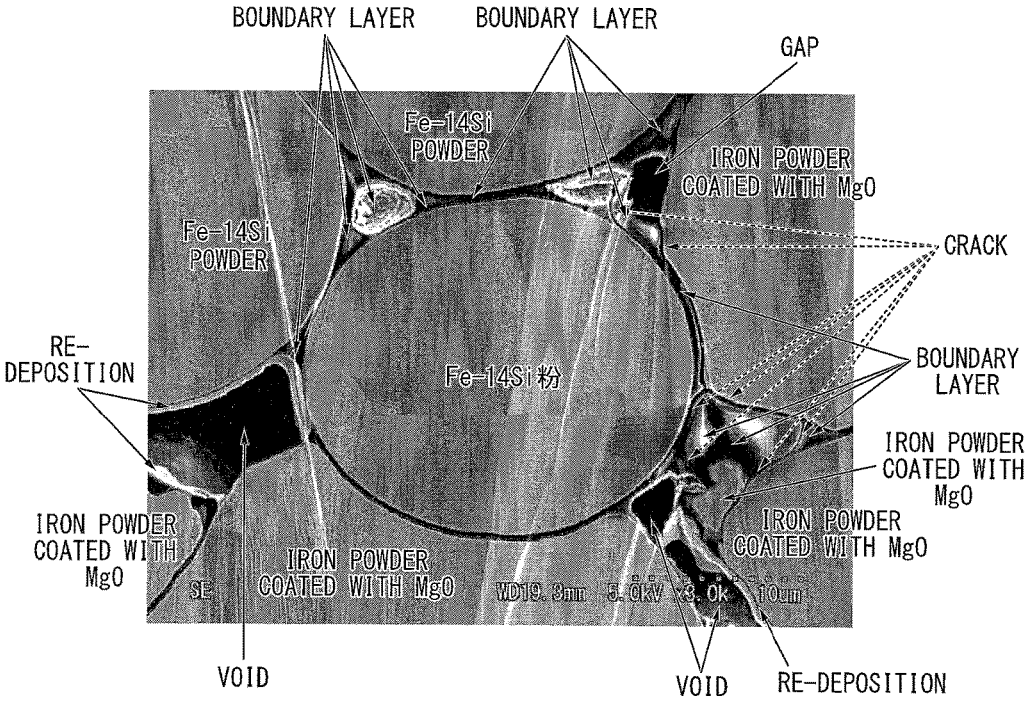
FIG. 3 is a structure photograph of a sample in which 40% by mass of a negative magnetostriction material powder obtained in an example is mixed.

FIG. 3 shows a SEM image (at a 3.000-fold magnification) illustrating a structure of the sample produced by mixing 60% by mass of the iron powder coated with MgO, and 40% by mass of the Fe—Si alloy powder among the samples shown in Table 1.

In the structure shown in FIG. 3, a particle that has a circular cross-section and that is disposed at the center is the Fe—Si alloy powder (particle), and a particle that is disposed at the periphery of the above-described particle, that has irregularity portions, and that abuts on the Fe—Si alloy powder is the iron powder coated with MgO. The iron powder coated with MgO is softer than the Fe—Si alloy powder; and therefore, the structure shown in FIG. 3 is obtained. A grain boundary (boundary layer) in which a baked material of a silicone resin is filled is formed at a grain boundary located at the periphery of the central Fe—Si alloy powder in FIG. 3.

Specifically, at the periphery of the circular Fe—Si alloy powder (Fe-14 Si powder) located at the center in FIG. 3, the iron powders coated with MgO are disposed at the right side and the lower side, and circular Fe—Si alloy powder are disposed at the upper left side and the upper side. At the periphery of the circular Fe—Si alloy powder (Fe-14 Si powder) located at the center in FIG. 3, four grain boundaries are shown at the lower left position, the upper left position, the upper right position, and the lower right position, respectively.

Black hollow portions that are present at the lower left grain boundary, the upper right grain boundary, and the lower right grain boundary in FIG. 3 represent voids. In the upper left grain boundary, a white boundary layer formed from the baked material of the silicone resin is filled. With regard to the upper right grain boundary, a boundary layer is formed at the periphery of a black void portion. With regard to the lower right grain boundary, a white portion serves as a boundary layer. In addition, it was confirmed that a plurality of cracks indicated by arrows in FIG. 3 are present in grain boundaries that are particularly located at the lower right side and the upper right side.

In addition, re-deposition described in FIG. 3 represents a re-attached material that is generated when a part of a sample sputtered by ion beams is re-attached to a cross-section during production of the cross-section of the sample for photography.

Figure 4:
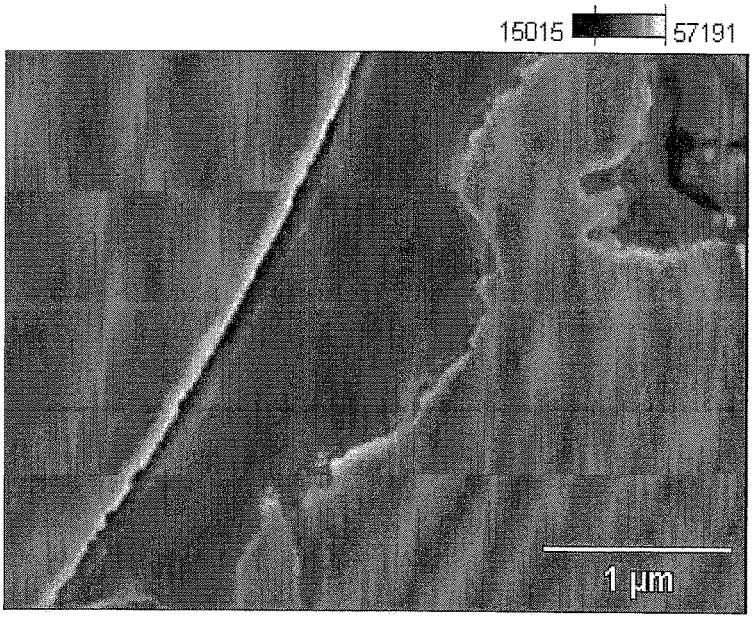
FIG. 4 is an enlarged structure photograph of a portion having a gap in a sample obtained in an example.

FIG. 4 shows an enlarged photograph of a crack portion at a different viewing field of the same sample. A three-layer structure of the Fe—Si alloy powder located at the left end of FIG. 4, the baked material of the silicone resin present at the right side thereof, and the iron powder coated with MgO present at the right side thereof was confirmed. In the enlarged photograph of FIG. 4, the baked material of the silicone resin is filled in a region between the Fe—Si alloy powder particle located at the left side and the iron powder particle coated with Mg located at the right side.

In addition, it was confirmed that a crack (gap) displayed at a black edge portion is present at a boundary portion between the left side Fe—Si alloy powder and the baked material of the silicone resin present on the right side of the Fe—Si alloy powder. The reason why the gap is caused may be assumed to be that a heterogeneous silicone resin is used. The gap is present between the Fe—Si alloy powder and the boundary layer that is present at the periphery of the Fe—Si alloy powder and that is formed from the baked material of the silicone resin in the above-described manner; and thereby, the samples shown in Table 1 have a magnetostriction absorption effect slightly more excellent than the samples shown in Table 3. Due to this cause, it may be assumed that a value of magnetostriction at 0.5 T in Table 1 is slightly more excellent than a value of magnetostriction at 0.5 T in Table 3.

Figure 5:
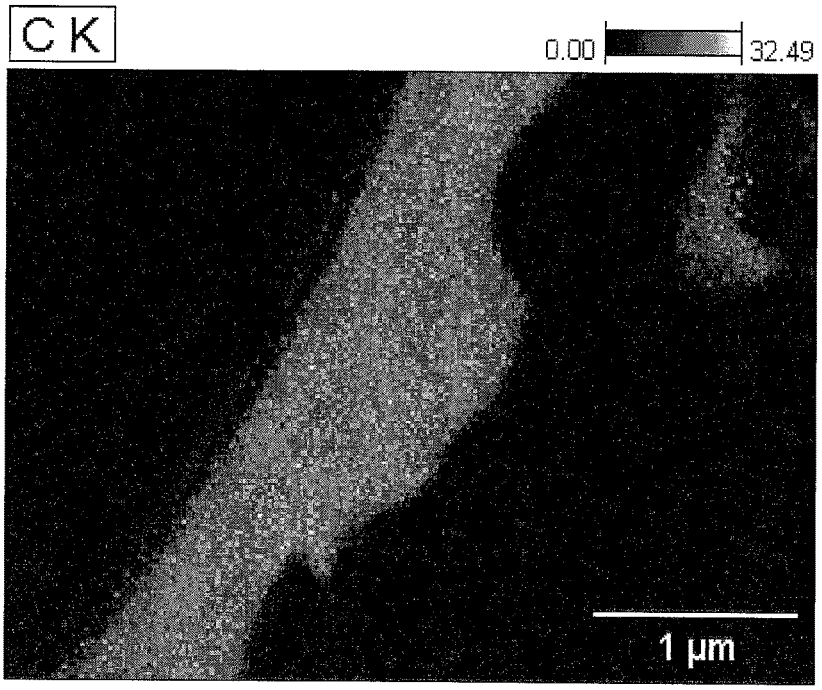
FIG. 5 is a SEM-EDS surface analysis photograph illustrating a carbon distribution state in the portion shown in FIG. 4.
Figure 6:
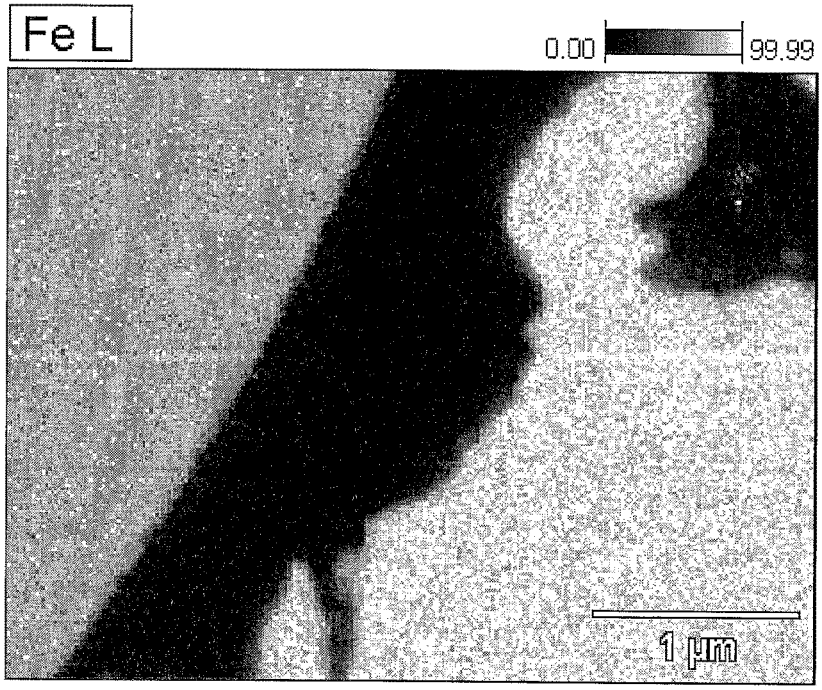
FIG. 6 is a SEM-EDS surface analysis photograph illustrating an iron distribution state in the portion shown in FIG. 4.
Figure 7:
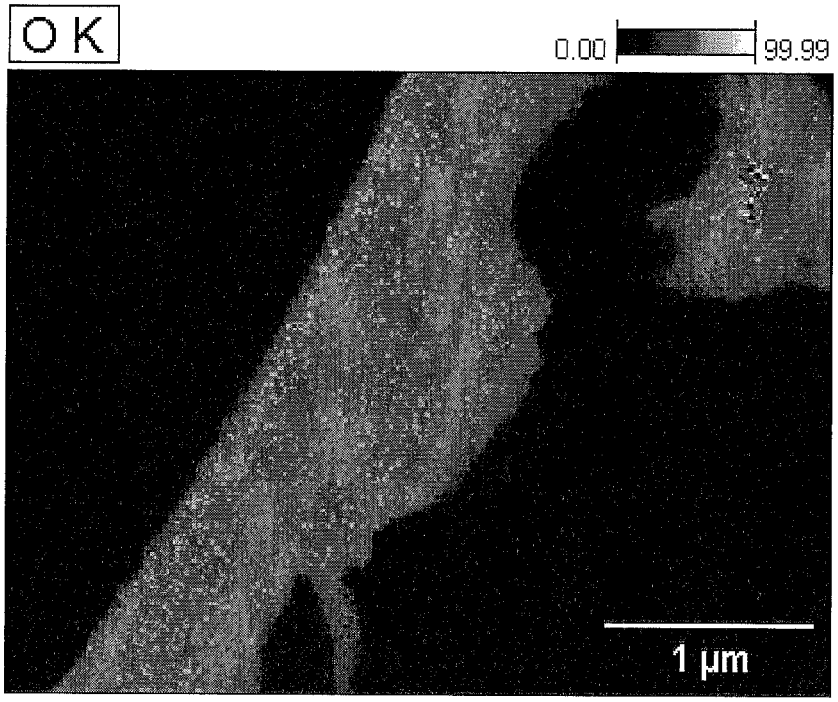
FIG. 7 is a SEM-EDS surface analysis photograph illustrating an oxygen distribution state in the portion shown in FIG. 4.
Figure 8:
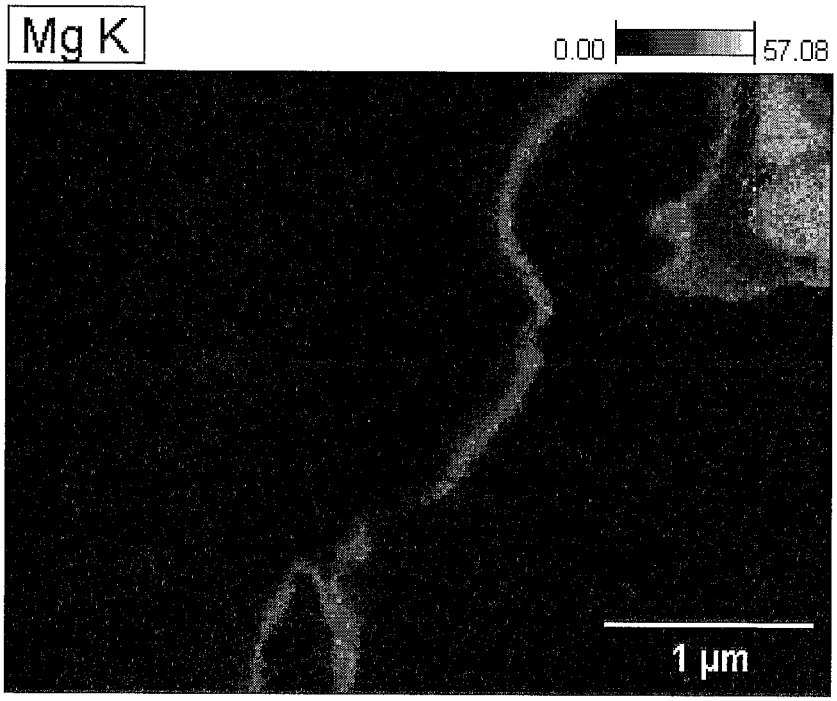
FIG. 8 is a SEM-EDS surface analysis photograph illustrating a magnesium distribution state in the portion shown in FIG. 4.
Figure 9:
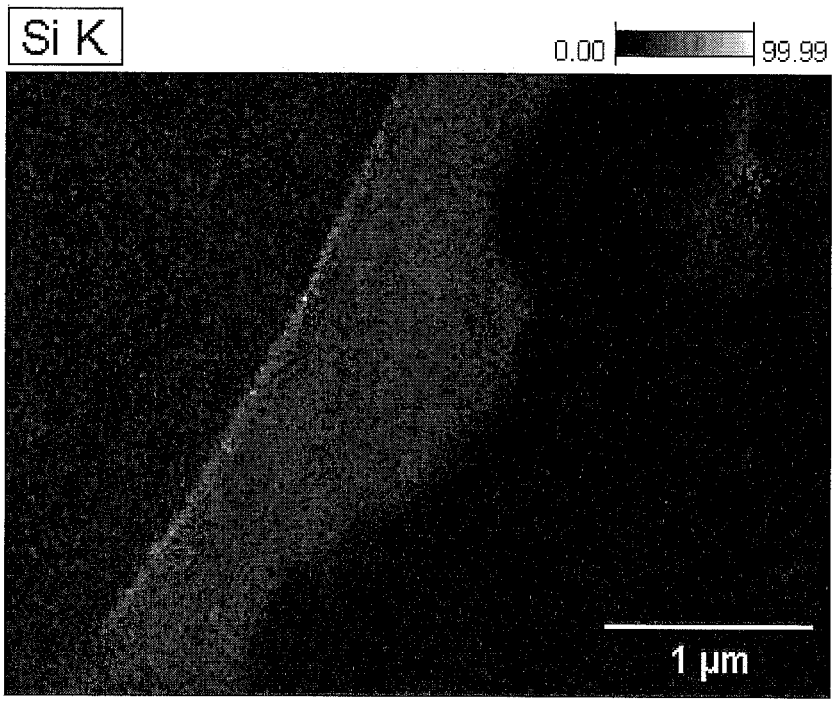
FIG. 9 is a SEM-EDS surface analysis photograph illustrating a silicon distribution state in the portion shown in FIG. 4.

FIG. 5 to FIG. 9 show results of SEM-EDS surface analysis carried out with respect to the metal structure shown in FIG. 4. FIG. 5 shows an analysis result of carbon (C), FIG. 6 shows an analysis result of iron (Fe), FIG. 7 shows an analysis result of oxygen (O), FIG. 8 shows an analysis result of magnesium (Mg), and FIG. 9 shows an analysis result of silicon (Si).

From the results shown in FIGS. 5 to 9, it can be understood that a silicone resin including C, O, and Si as constituent elements is present at a grain boundary, and MgO film is present at the periphery of the iron powder.

INDUSTRIAL APPLICABILITY

An aspect of the composite soft magnetic material having low magnetostriction and high magnetic flux density of the present invention can realize compatibility of low magnetostriction and high magnetic flux density; and therefore, the material can be used as a material of various electromagnetic circuit components. Examples of the electromagnetic circuit components include a magnetic core, an electric motor core, a power generator core, a solenoid core, an ignition core, a reactor core, a transformer core, a choke coil core, a magnetic sensor core, and the like. With any one of these, an electromagnetic circuit component capable of exhibiting excellent magnetic properties can be provided. In addition, examples of electric apparatuses to which the electromagnetic circuit component is assembled include an electric motor, a power generator, a solenoid, an injector, an electromagnetic drive valve, an inverter, a converter, a transformer, a relay, a magnetic sensor system, and the like. An aspect of the composite soft magnetic material having low magnetostriction and high magnetic flux density of the present invention can contribute to high efficiency, high performance, and reduction in size and weight of the electric apparatuses.

DESCRIPTION OF REFERENCE SIGNS

A: Composite soft magnetic material having low magnetostriction and high magnetic flux density

1: Mg-containing insulating film

2: Composite soft magnetic powder particle

3: Fe—Si alloy powder particle

4: Pure iron powder particle

5: Boundary layer

The invention claimed is:

1. A composite soft magnetic material comprising:

pure iron-based composite soft magnetic powder particles prepared by subjecting pure iron powder to an insulating treatment to form a Mg-containing insulating film or a phosphate film on a surface of the pure iron powder particles; and Fe—Si alloy powder particles consisting of 11% by mass to 16% by mass of Si and a remainder of Fe, wherein a ratio of an amount of the Fe—Si alloy powder particles to a total amount of both of the pure iron-based composite soft magnetic powder particles and the Fe—Si alloy powder particles is in a range of 10% by mass to 60% by mass, and wherein boundary layers are included between the pure iron-based composite soft magnetic powder particles, between the Fe—Si alloy powder particles, and between the pure iron-based composite soft magnetic powder particle and the Fe—Si alloy powder particle.

2. The composite soft magnetic material according to claim 1, wherein a film thickness of the Mg-containing insulating film is in a range of 5 nm to 200 mn.

3. The composite soft magnetic material according to claim 2, wherein the composite soft magnetic material is manufactured by a method which includes the steps of:

preparing the pure iron-based composite soft magnetic powder by subjecting the pure iron powder to the insulating treatment to form the Mg-containing insulating film on the surface of the pure iron powder particles;

mixing the pure iron-based composite soft magnetic powder and the Fe—Si alloy powder;

subjecting a resultant mixture to compression molding; and subjecting a resultant molded body to a heat treatment, wherein the pure iron-based composite soft magnetic powder is added to form the pure iron-based composite soft magnetic powder particles, and the Fe—Si alloy powder is added to form the Fe—Si alloy powder particles.

4. The composite soft magnetic material according to claim 3, wherein silicone resin is added and mixed in addition to the pure iron-based composite soft magnetic powder and the Fe—Si alloy powder, the resultant mixture is subjected to the compression molding, and the resultant molded body is subjected to the heat treatment, and thereby, the composite soft magnetic material is manufactured.

5. The composite soft magnetic material according to claim 4, wherein the boundary layer, which consists of a baked material of a silicone resin is generated at an interface between the pure iron-based composite soft magnetic powder particles and the Fe—Si alloy powder particles.

6. The composite soft magnetic material according to claim 3, wherein positive magnetostriction of the pure iron-based composite soft magnetic powder particles is mitigated by negative magnetostriction of the Fe—Si alloy powder particles to obtain a magnetostriction in a range of $-2\times10^{-6}$ to $+2\times10^{-6}$ with a magnetic flux density in a range of 0 T to 0.5 T.

7. An electromagnetic circuit component comprising:

the composite soft magnetic material according to claim 3.

8. The composite soft magnetic material according to claim 2, wherein positive magnetostriction of the pure iron-based composite soft magnetic powder particles is mitigated by negative magnetostriction of the Fe—Si alloy powder particles to obtain a magnetostriction in a range of $-2\times10^{-6}$ to $+2\times10^{-6}$ with a magnetic flux density in a range of 0 T to 0.5 T.

9. An electromagnetic circuit component comprising:

the composite soft magnetic material according to claim 2.

10. The composite soft magnetic material according to claim 1, wherein positive magnetostriction of the pure iron-based composite soft magnetic powder particles is mitigated by negative magnetostriction of the Fe—Si alloy powder particles to obtain a magnetostriction in a range of $-2\times10^{-6}$ to $+2\times10^{-6}$ with a magnetic flux density in a range of 0 T to 0.5 T.

11. An electromagnetic circuit component comprising:

the composite soft magnetic material according to claim 1.

12. A method for producing a composite soft magnetic material, the method comprising the steps of:

preparing a pure iron-based composite soft magnetic powder by subjecting pure iron powder to an insulating treatment to form a Mg-containing insulating film on a surface of the pure iron powder particles;

mixing the pure iron-based composite soft magnetic powder and an Fe—Si alloy powder consisting of 11% by mass to 16% by mass of Si and a remainder of Fe in such a manner that a ratio of an amount of the Fe—Si alloy powder to a total amount of both of the pure iron-based composite soft magnetic powder and the Fe—Si alloy powder is in a range of 10% by mass to 60% by mass;

subjecting a resultant mixture to compression molding; and subjecting a resultant molded body to a heat treatment at a temperature of 500° C. to 1,000° C. in a non-oxidizing atmosphere.

13. The method for producing a composite soft magnetic material according to claim 12, wherein the Mg-containing insulating film has a film thickness of 5 nm to 200 nm.

14. The method for producing a composite soft magnetic material according to claim 13, wherein a silicone resin is added and mixed in addition to the pure iron-based composite soft magnetic powder and the Fe—Si alloy powder, the resultant mixture is subjected to the compression molding, and the resultant molded body is subjected to the heat treatment, and thereby, a boundary layer is generated, which consists of a baked material of the silicone resin, at an interface between the pure iron-based composite soft magnetic powder particles and the Fe—Si alloy powder particles.

15. The method for producing a composite soft magnetic material according to claim 12, wherein a silicone resin is added and mixed in addition to the pure iron-based composite soft magnetic powder and the Fe—Si alloy powder, the resultant mixture is subjected to the compression molding, and the resultant molded body is subjected to the heat treatment, and thereby, a boundary layer is generated, which consists of a baked material of the silicone resin, at an interface between the pure iron-based composite soft magnetic powder particles and the Fe—Si alloy powder particles.

* * * * *